US008689982B2

(12) United States Patent
Karmeniemi et al.

(10) Patent No.: US 8,689,982 B2
(45) Date of Patent: Apr. 8, 2014

(54) PARTICLE SEPARATING DEVICE

(75) Inventors: Timo Karmeniemi, Helsinki (FI); Jukka Tuunanen, Helsinki (FI)

(73) Assignee: Thermo Fisher Scientific Oy, Vantaa (FI)

( * ) Notice: Subject to any disclaimer, the term of this patent is extended or adjusted under 35 U.S.C. 154(b) by 827 days.

(21) Appl. No.: 10/578,861

(22) PCT Filed: Nov. 9, 2004

(86) PCT No.: PCT/FI2004/000658

§ 371 (c)(1),
(2), (4) Date: Apr. 10, 2007

(87) PCT Pub. No.: WO2005/044460

PCT Pub. Date: May 19, 2005

(65) Prior Publication Data

US 2007/0221543 A1 Sep. 27, 2007

(30) Foreign Application Priority Data

Nov. 11, 2003 (FI) ..... 20031635

(51) Int. Cl.
*B03C 1/00* (2006.01)

(52) U.S. Cl.
USPC ..... 209/215; 209/223.1; 210/695

(58) Field of Classification Search
USPC ..... 209/213–232; 210/222, 223, 695
See application file for complete search history.

(56) References Cited

U.S. PATENT DOCUMENTS

| | | | | | |
|---|---|---|---|---|---|
| 4,966,618 | A | * | 10/1990 | Letemps et al. | 65/106 |
| 4,988,618 | A | | 1/1991 | Li et al. | |
| 5,318,914 | A | | 6/1994 | Matte et al. | |
| 5,458,785 | A | * | 10/1995 | Howe et al. | 210/695 |
| 5,567,326 | A | * | 10/1996 | Ekenberg et al. | 210/695 |
| 5,779,907 | A | | 7/1998 | Yu | |
| 6,132,607 | A | * | 10/2000 | Chen et al. | 210/208 |
| 6,409,925 | B1 | * | 6/2002 | Gombinsky et al. | 210/695 |
| 6,514,415 | B2 | * | 2/2003 | Hatch et al. | 210/695 |
| 6,514,416 | B1 | * | 2/2003 | Harradine et al. | 210/695 |
| 2002/0070173 | A1 | | 6/2002 | Otto et al. | |
| 2002/0084225 | A1 | | 7/2002 | Hatch et al. | |

FOREIGN PATENT DOCUMENTS

| | | |
|---|---|---|
| EP | 0 136 126 | 4/1985 |
| JP | 2-133438 | 5/1990 |
| JP | 7-25949 | 1/1995 |
| WO | WO 92/05443 | 4/1992 |
| WO | WO 94/18565 | 8/1994 |
| WO | WO 96/12958 | 5/1996 |
| WO | WO 02/066165 A2 | 8/2002 |

OTHER PUBLICATIONS

International Search Report mailed Jul. 25, 2006 in PCT/FI2004/000658.
Translation of Corresponding JP Patent Application 2006-538874 Office Action dated Nov. 4, 2010.

* cited by examiner

*Primary Examiner* — Joseph C Rodriguez
*Assistant Examiner* — Kalyanavenkateshware Kumar
(74) *Attorney, Agent, or Firm* — Nixon & Vanderhye P.C.

(57) ABSTRACT

The invention relates to a device (2) for separating magnetic particles comprising several substantially aligned magnets (3). Some of the magnets (3) are inversely oriented. This array reduces any magnetic interference with the collection area of an adjacent magnet.

13 Claims, 3 Drawing Sheets

Figure 1:
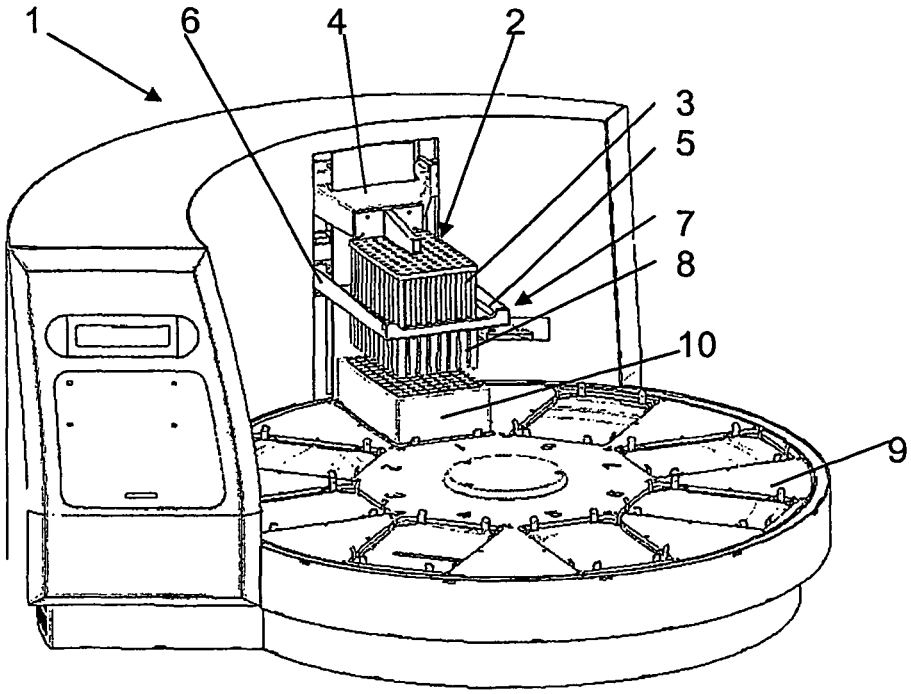

| | 1 | 2 | 3 | 4 | 5 | 6 | 7 | 8 | 9 | 10 | 11 | 12 |
|---|---|---|---|---|---|---|---|---|---|---|---|---|
| A | N | S | N | S | N | S | N | S | N | S | N | S |
| B | S | N | S | N | S | N | S | N | S | N | S | N |
| C | N | S | N | S | N | S | N | S | N | S | N | S |
| D | S | N | S | N | S | N | S | N | S | N | S | N |
| E | N | S | N | S | N | S | N | S | N | S | N | S |
| F | S | N | S | N | S | N | S | N | S | N | S | N |
| G | N | S | N | S | N | S | N | S | N | S | N | S |
| H | S | N | S | N | S | N | S | N | S | N | S | N |

Fig. 4

| | 1 | 2 | 3 | 4 | 5 | 6 | 7 | 8 | 9 | 10 | 11 | 12 |
|---|---|---|---|---|---|---|---|---|---|---|---|---|
| A | S | N | S | N | S | N | S | N | S | N | S | N |
| B | S | N | S | N | S | N | S | N | S | N | S | N |
| C | S | N | S | N | S | N | S | N | S | N | S | N |
| D | S | N | S | N | S | N | S | N | S | N | S | N |
| E | S | N | S | N | S | N | S | N | S | N | S | N |
| F | S | N | S | N | S | N | S | N | S | N | S | N |
| G | S | N | S | N | S | N | S | N | S | N | S | N |
| H | S | N | S | N | S | N | S | N | S | N | S | N |

Fig. 5

| | 1 | 2 | 3 | 4 | 5 | 6 | 7 | 8 | 9 | 10 | 11 | 12 |
|---|---|---|---|---|---|---|---|---|---|---|---|---|
| A | S | N | N | S | S | N | N | S | S | N | N | S |
| B | S | N | N | S | S | N | N | S | S | N | N | S |
| C | S | N | N | S | S | N | N | S | S | N | N | S |
| D | S | N | N | S | S | N | N | S | S | N | N | S |
| E | S | N | N | S | S | N | N | S | S | N | N | S |
| F | S | N | N | S | S | N | N | S | S | N | N | S |
| G | S | N | N | S | S | N | N | S | S | N | N | S |
| H | S | N | N | S | S | N | N | S | S | N | N | S |

Fig. 6

| | 1 | 2 | 3 | 4 | 5 | 6 | 7 | 8 | 9 | 10 | 11 | 12 |
|---|---|---|---|---|---|---|---|---|---|---|---|---|
| A | N | S | N | S | N | S | N | S | N | S | N | S |
| B | S | N | S | N | S | N | S | N | S | N | S | N |
| C | S | N | S | N | S | N | S | N | S | N | S | N |
| D | S | N | S | N | S | N | S | N | S | N | S | N |
| E | S | N | S | N | S | N | S | N | S | N | S | N |
| F | S | N | S | N | S | N | S | N | S | N | S | N |
| G | S | N | S | N | S | N | S | N | S | N | S | N |
| H | N | S | N | S | N | S | N | S | N | S | N | S |

Fig. 7

| | 1 | 2 | 3 | 4 | 5 | 6 | 7 | 8 | 9 | 10 | 11 | 12 |
|---|---|---|---|---|---|---|---|---|---|---|---|---|
| A | S | S | S | S | S | S | S | S | S | S | S | S |
| B | S | N | N | N | N | N | N | N | N | N | N | S |
| C | S | N | N | N | N | N | N | N | N | N | N | S |
| D | S | N | N | N | N | N | N | N | N | N | N | S |
| E | S | N | N | N | N | N | N | N | N | N | N | S |
| F | S | N | N | N | N | N | N | N | N | N | N | S |
| G | S | N | N | N | N | N | N | N | N | N | N | S |
| H | S | S | S | S | S | S | S | S | S | S | S | S |

Fig. 8

| | 1 | 2 | 3 | 4 | 5 | 6 | 7 | 8 | 9 | 10 | 11 | 12 |
|---|---|---|---|---|---|---|---|---|---|---|---|---|
| A | S | S | S | S | S | S | S | S | S | S | S | S |
| B | S | N | N | N | N | N | N | N | N | N | N | S |
| C | S | N | S | S | S | S | S | S | S | S | N | S |
| D | S | N | S | N | N | N | N | N | N | S | N | S |
| E | S | N | S | N | N | N | N | N | N | S | N | S |
| F | S | N | S | S | S | S | S | S | S | S | N | S |
| G | S | N | N | N | N | N | N | N | N | N | N | S |
| H | S | S | S | S | S | S | S | S | S | S | S | S |

Fig. 9

PARTICLE SEPARATING DEVICE

This application is the U.S. national phase of international application PCT/F12004/000658 filed 9 Nov. 2004 which designated the U.S. and claims benefit of Fl 20031635, dated 11 Nov. 2003, the entire content of which is hereby incorporated by reference.

FIELD OF TECHNOLOGY

The invention relates to techniques for separating magnetic particles and is directed to a device used in the separation. The invention is applicable to various chemical methods for separating particles from liquid mixtures containing them.

BACKGROUND OF TECHNOLOGY

Magnetic particles are employed in various methods as a solid phase on whose surface a reaction is allowed to occur. A particle is typically coated with a substance having a specific reaction with a given second substance. This allows separation of this second substance from a mixture in which it is contained.

The particles usually need to be separated from the reaction mixture after the reaction. This has been conventionally done by removing the reaction medium from the vessel and by leaving the particles in the vessel.

WO 94/18565 discloses a method and a device for separating particles by removing them from a vessel. This is done with the aid of an elongated remover comprising a magnet located within a casing and movable in it in the longitudinal direction. As the remover is introduced into a mixture with the magnet in lower position, the particles adhere to the surface of the remover and can thus be removed from the mixture. By contrast, as the magnet is pulled into upper position, the particles are detached from the surface of the remover. The device may comprise a plurality of removers operating in parallel so as to allow simultaneous treatment of a plurality of samples. WO 96/12958 discloses a similar remover, whose magnet has a length such that only the lower pole of the magnet collects particles. Such separating techniques have also been commercially implemented in the KingFisher® separating devices of Thermo Electron Oy, Finland. These devices comprise a plurality of removers disposed in parallel, with their magnets oriented in the same direction, i.e. with similar poles always oriented in the same direction.

SUMMARY OF THE INVENTION

A separating device as defined in claim 1 has now been invented. The other claims define some embodiments of the invention.

In accordance with the invention, the separating device comprises a plurality of substantially aligned magnets in parallel. Some of the magnets are oriented in the opposite direction. This array reduces the effect of the magnets on the separation areas of adjacent magnets.

The greater the number of magnets included in the separating device, the more useful the invention.

DRAWINGS

Figure 2:
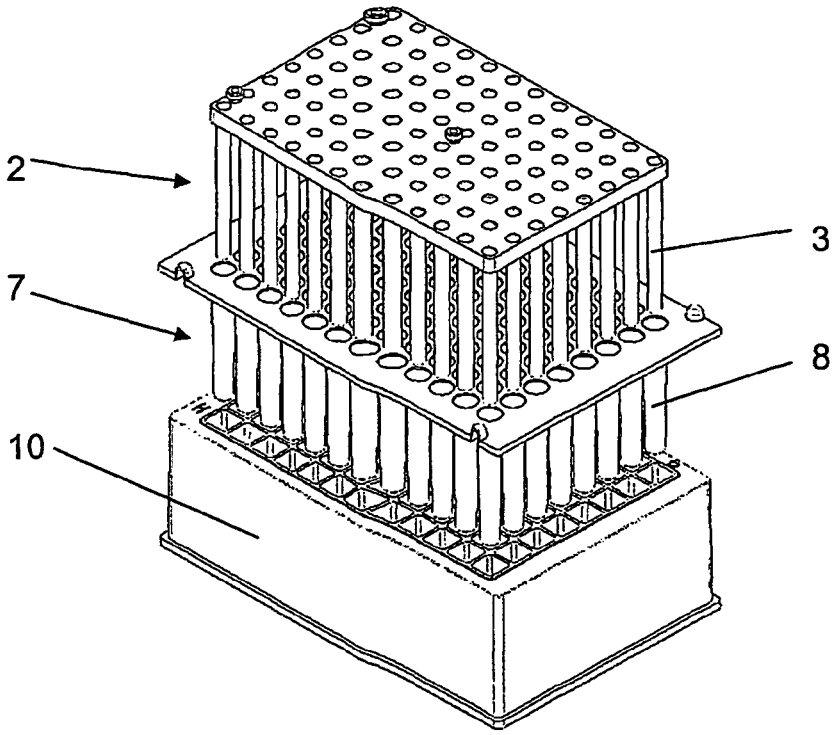
Figure 3:
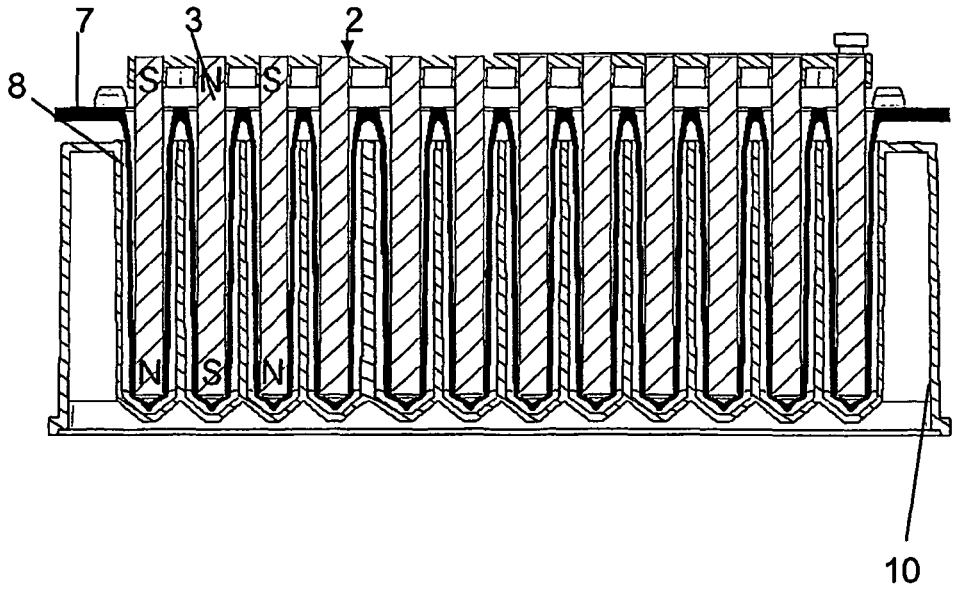

The accompanying drawings pertain to the written description of the invention and relate to the detailed description of the invention given below. In the drawings, FIG. 1 shows a separating apparatus of the invention FIG. 2 shows the separating device of the separating apparatus and separately the comb of casings and sample plate used with the separating device FIG. 3 is a cross-sectional view of the separating device, comb of casings and sample plate in nested arrangement FIGS. 4-9 illustrate various manners of positioning the magnets in opposite directions.

DETAILED DESCRIPTION OF THE INVENTION

The separating device of the invention comprises a plurality of aligned magnets substantially in parallel, a number of which are oriented in the opposite direction, in other words, with the north pole of at least one magnet directed upwardly and the north pole of at least another directed downwardly. Thus, for instance, about half of the magnets may be inversely oriented, especially with every second magnet oriented in the opposite direction. The magnets may particularly be placed in a matrix array comprising a plurality of magnet rows. This allows the magnets to be positioned e.g. with the magnets of an entire row, especially a shorter row in the case of a matrix not shaped as a square, all oriented in the same direction. Developments of various different combinations are also conceivable.

The invention provides the benefit of the magnets interfering less with particle collection from the collecting areas of adjacent magnets. In particular, it reduces particle adhesion to the side walls of the separating vessel. In fact, the inventors have found that, because the fields formed of equally oriented magnets reject each other, the fields of the magnets in the border zone are slightly tilted towards the border areas of the magnet matrix due to the rejecting effect of the magnets in the central area. Inclined magnetic field beams tend to act also on the neighbouring vessel, thus binding part of the particles of the adjacent vessel to the vessel walls. These particles are at risk of not being collected by the magnet specific to this vessel, and there will thus remain uncollected particles in the well. With the magnets positioned in the opposite direction in accordance with the invention, the magnetic fields will be fixed between the magnets. With the magnetic fields locally fixed, the magnets will not generate a far-reaching rejecting effect, and the collection will be locally defined to the vessel located at the magnet.

The invention also provides other, partly quite different advantages. Firstly, the effect of external disturbing factors will decrease. Magnetic materials outside the magnet matrix (tracks, motors, box structures) tend to act on the inclination of the field beams generated by the magnets. The field of magnets oriented in the opposite direction will be fixed between the magnets, resulting in a decrease of such interference. Secondly, a weaker magnetic field will now act outside the separating device. This reduces any interference with other apparatus. This also facilitates protection during transport. Air transportation, for instance, is subject to specific upper limits for the magnetic field generated by the freight. Magnetic fields might also cause interference with for instance therapeutic devices such as pacemakers. Thirdly, magnets will be bent to a lesser extent under the action of attractive forces of the free poles of adjacent magnets with alternating pole directions than they are under the action of repulsive forces of like poles.

Magnets are usually united into one single piece, called a magnet head. The magnet head may be disposed vertically movable in a separating device.

Each magnet head may have a casing in which it is movable. The casings are also usually joined to form one single piece disposed in the device so as to be vertically movable under the magnet head.

The magnets may especially be elongated so as to allow particle collection on the tip of the separator (cf. WO 96/12959). The ratio of the length to the thickness of the magnet may be e.g. at least about 2:1, such as at least 5:1. During particle collection, the upper pole of the magnet is preferably kept above the mixture. However, conventional short magnets are also applicable. The separator tip is preferably pointed and convex (cf. WO 94/18564, WO 94/18565 and WO 96/12959). An agent for reducing surface tension may be dosed into the mixture containing the particles, thus enhancing particle adhesion to the separator (cf. WO 00/42432).

The magnet particles to be separated may be micro particles in particular. The maximum particle size is e.g. 50 μm, such as 10 μm. The minimum size may be e.g. 0.05 μm. The typical particle size is in the range 0.5-10 μm.

Particles are usually coated with a substance having specific reaction with a component in the sample.

Some embodiments of the invention are further disclosed in detail below.

The separating apparatus 1 is used for treating samples in micro filtration plate format comprising 8*12 wells with a 9 mm distribution.

The apparatus has a magnet head 2 comprising 96 elongated permanent magnets 3 (length/thickness about 10:1) with the same distribution as the plate, the upper ends of the permanent magnets being joined by means of a support plate. The magnets are preferably made of a material (e.g. NeFeB) that has high remanence and coercivity. The magnet head is fixed to a lifting device 4, which is movable in the vertical direction. At the same location under the magnet head a casing support 5 is provided, which has a hole at the location of each magnet. The casing support is fixed to a lifting device 6 so as to be movable in the vertical direction. A comb of casings 7 is disposed on the casing support, this comb of casings 7 comprising a plurality of individual casing wells 8 for insertion of each magnet 3 of the magnet head 2. At their lower ends, each of the casing wells 8 has a separating area shaped as a cone with a concave surface, with a sharp lower tip at the centre.

The apparatus comprises a rotating tray 9 with locations for sample plates 10. By rotating the tray 9, the desired plate 10, whose wells have a liquid mixture containing magnetic particles to be separated therefrom, is placed in a treatment position under the magnet head 2. When it is desirable to remove the particles from the liquid mixture in the wells of the sample plate 10, the magnet head 2 is lowered into the comb of casings 7 and these two are inserted together into the wells of the sample plate 10. The particles in the wells of the sample plate 10 now adhere to the separating area of the casing wells 8. After this, the comb of casings 7 and the magnet head 2 are lifted together. When the magnetic particles are to be released, the comb of casings 7 and the magnet head 2 are lowered jointly into the wells of another sample plate 10, and after this the magnet head 2 is lifted first, and then the comb of casings 7. Both in the steps of removing and of releasing the magnetic particles, the comb of casings 7 may perform a number of reciprocating movements (cf. WO 94/18565). In FIG. 1, the treatment station comprises a plate 10 with relatively high wells, such a plate being usable especially for performing a separating reaction. It is, of course, possible to use also plates with lower wells, and then the casings can be accordingly shorter.

The magnets 3 of the magnet head 2 are positioned with some of the magnets turned in the opposite direction. FIGS. 4-9 illustrate such different arrays. The matrix of the magnet head comprises eight horizontal rows (A . . . H) and twelve vertical rows (1 . . . 12) corresponding to the micro plate.

In FIG. 4, every second magnet is inversely oriented.

In FIGS. 5 and 6, the magnets are disposed inversely row-wise with the magnets of the shorter row oriented in same direction.

In FIG. 7, the longer lateral rows comprise every second magnet with alternating pole directions, and in the intermediate portion the magnets are positioned with alternating pole directions row-wise, with the magnets of the shorter row oriented in same direction.

In FIG. 8, the magnets of the lateral rows are oriented in same direction and those of the remaining rows are oriented in the opposite direction.

The magnets in FIG. 9 are positioned with alternating pole directions circumferentially.

The invention claimed is:

1. A device for separating magnetic particles from a liquid mixture thereof, the device comprising:

a sample plate defining a plurality of wells for containing a liquid mixture comprised of a liquid and magnetic particles to be separated therefrom, a magnet head which is movable between raised and lowered positions relative to the wells of the sample plate, and a plurality of substantially parallel and individually separated permanent magnets each having an upper end fixed to the magnet head and a lower free end opposite to the upper end, the magnets being positioned relative to the sample plate so that each of the magnets is aligned with a respective one of the wells of the sample plate such that movement of the magnet head between the raised and lowered positions causes the lower free end of each magnet to be removed from and disposed within the respective one of the wells, respectively, wherein each of the magnets is capable of being introduced into the liquid mixture contained in a respective one of the wells when the magnet head is in the lowered position thereof to thereby separate the magnetic particles within each of the wells from the liquid and collect the separated magnetic particles at the lower free end of the magnet, and wherein at least some of the magnets are inversely oriented such that magnetic fields are fixed between adjacent ones of the magnets to thereby locally define collection of the magnetic particles at each magnet introduced into the liquid mixtures of the wells.

2. A separating device as defined in claim 1, in which about half of the magnets are inversely oriented.

3. A separating device as defined in claim 2, in which substantially every second magnet is inversely oriented.

4. A separating device as defined in claim 1, in which magnets are disposed in several rows of several magnets.

5. A separating device as defined in claim 1, in which the magnets are permanent magnets whose length/diameter ratio is at least about 2:1.

6. An apparatus for separating magnetic particles from a liquid mixture comprised of a liquid and the magnetic particles, wherein the apparatus comprises:

a sample plate defining a plurality of wells for containing a liquid mixture comprised of a liquid and magnetic particles to be separated therefrom, and a vertically movable separating device which comprises a magnet head including several substantially parallel and individually separated permanent magnets positioned relative to the sample plate so that each of the magnets is aligned with a respective one of the sample wells of the sample plate, wherein each of the magnets has an upper end fixed to the magnet head and a lower free end opposite the upper end thereof, each magnet being moveable with the magnet head between a raised position wherein the lower free end of the magnet is removed from the respective one of the sample wells and a lowered position wherein the lower free end of the magnet is received within the respective one of the wells so that each of the magnets is capable of being introduced into the liquid mixture contained in a respective one of the wells, wherein the magnetic particles within each of the wells are separated from the liquid and collected at the lower free end of the magnet, and wherein at least some of the magnets are inversely oriented such that magnetic fields are fixed between adjacent ones of the magnets to thereby locally define collection of the magnetic particles at each magnet introduced into the liquid mixtures of the wells.

7. An apparatus as defined in claim 6, wherein the separating device further comprises:

a vertically movable casing which defines a plurality of casing wells for receiving a respective one of the magnets of the magnet head, wherein the casing wells are positioned relative to the sample plate wells of the sample plate such that each of the sample plate wells is capable of receiving a respective one of the casing wells, and wherein the magnetic particles of the liquid mixture in the sample wells adhere to a separating area of the casing wells in response to the casing wells and the magnets received therein being moved vertically as a unit into a receiving relationship within the sample wells.

8. An apparatus as defined in claim 7, in which the casings are united to form one single piece.

9. An apparatus as defined in claim 1, wherein the magnets are elongated, and wherein the apparatus comprises a support plate, and wherein the magnets are joined to and extend outwardly from the support plate.

10. An apparatus for separating magnetic particles from a liquid mixture thereof, the apparatus comprising:

a sample plate defining a plurality of wells for containing a liquid mixture comprised of a liquid and magnetic particles to be separated therefrom, and a separating device comprising, (a) a reciprocally movable casing which defines a plurality of casing wells each having a respective separating surface, wherein each of the casing wells is positioned so as to be reciprocally movable into and out of a received relationship with a respective one of the sample plate wells;

(b) a reciprocally movable magnet head which comprises a plurality of elongate individually separated permanent magnets, wherein each magnet has an upper end fixed to the magnet plate and a lower free end opposite the upper end thereof, each magnet being positioned substantially parallel to one another so as to be reciprocally movable with the magnet head into and out of a received relationship with a respective one of the sample plate wells, wherein at least some of the magnets are inversely oriented such that magnetic fields are fixed between adjacent ones of the magnets to thereby locally define collection of the magnetic particles at each magnet introduced into the liquid mixtures of the sample plate wells; wherein the casing having the magnets received within respective ones of the casing wells is capable of being reciprocally moved into contact with the liquid mixture contained in the sample plate wells such that the magnet particles adhere to the separating surface thereof, whereby the magnetic particles are separated from the liquid mixture, and wherein the magnet head is capable of being reciprocally movable relative to the casing such that the magnets are withdrawn from the casing wells so as to cause the magnetic particles to be released from the separating surface thereof.

11. An apparatus as in claim 10, wherein the magnet head comprises a support plate, wherein each of the magnets are joined to and extend outwardly from the support plate.

12. A method of separating magnetic particles from a liquid mixture thereof comprising:

(i) positioning a sample plate defining a plurality of wells for containing a liquid mixture comprised of a liquid and magnetic particles to be separated therefrom relative to a separating device comprised of a reciprocally movable casing which defines a plurality of casing wells each having a respective separating surface and a reciprocally movable magnet head which comprises a plurality of elongate individually separated permanent magnets positioned substantially parallel to one another, each magnet being reciprocally movable into and out of a received relationship with a respective one of the casing wells, wherein at least some of the magnets are inversely oriented such that magnetic fields are fixed between adjacent ones of the magnets to thereby locally define collection of the magnetic particles at each magnet introduced into the liquid mixtures of the wells, and (ii) reciprocally moving the casing having the magnets received within respective ones of the casing wells into contact with the liquid mixture contained in the sample plate wells such that the magnet particles adhere to the separating surface thereof, and subsequently (iii) withdrawing the casing wells from contact with the liquid mixture whereby the magnetic particles are separated from the liquid mixture.

13. The method of claim 12, further comprising:

(iv) reciprocally moving the magnet head relative to the casing such that the magnets are withdrawn from the casing wells so as to cause the magnetic particles to be released from the separating surface thereof.

* * * * *